US009702199B2

(12) United States Patent
Korf et al.

(10) Patent No.: US 9,702,199 B2
(45) Date of Patent: Jul. 11, 2017

(54) DEVICE FOR REMOVING ROTATING HEAD RUBBERS FROM DRILL PIPE

(71) Applicants: Andrew Korf, Billings, MT (US); William Haugen, Billings, MT (US)

(72) Inventors: Andrew Korf, Billings, MT (US); William Haugen, Billings, MT (US)

( * ) Notice: Subject to any disclaimer, the term of this patent is extended or adjusted under 35 U.S.C. 154(b) by 275 days.

(21) Appl. No.: 14/748,547

(22) Filed: Jun. 24, 2015

(65) Prior Publication Data

US 2016/0376872 A1 Dec. 29, 2016

(51) Int. Cl.
*E21B 17/10* (2006.01)
*E21B 17/00* (2006.01)

(52) U.S. Cl.
CPC ..... *E21B 17/006* (2013.01)

(58) Field of Classification Search
CPC ..... E21B 17/006; E21B 41/00; E21B 19/16; B25B 27/0028; B08B 9/23
USPC ..... 166/377, 380; 81/488, 120, 462, 121.1, 81/8.1; 15/104.04, 256.6
See application file for complete search history.

(56) References Cited

U.S. PATENT DOCUMENTS

| | | | | |
|---|---|---|---|---|
| 2,302,196 | A * | 11/1942 | Downs | B08B 9/023 104/89 |
| 2,690,847 | A | 10/1954 | Crookston | |
| 6,868,923 | B2 | 3/2005 | Mitchell | |
| 8,936,096 | B2 * | 1/2015 | Marshall | E21B 33/085 166/377 |
| 2002/0189804 | A1 * | 12/2002 | Liess | E21B 19/164 166/77.51 |
| 2004/0040720 | A1 | 3/2004 | Mitchell | |
| 2005/0061548 | A1 | 3/2005 | Hooper et al. | |
| 2015/0075814 | A1 | 3/2015 | Gerwing et al. | |

* cited by examiner

*Primary Examiner* — David Bagnell
*Assistant Examiner* — Dany Akakpo
(74) *Attorney, Agent, or Firm* — Antoinette M. Tease

(57) ABSTRACT

A device for removing rotating head rubbers from drill pipe comprising a base member, vertical shaft, lower pipe attachment bracket, left arm, right arm, diagonal shaft and upper pipe attachment member. Proximal ends of the left and right arms are welded to a top end of the vertical shaft, and the left and right arms lie in the same horizontal plane. Proximal ends of the left and right arms are welded together and distal ends of the left and right arms are separated so that the arms form a V-shaped fork. The diagonal shaft is welded to the top end of the vertical shaft at an upward angle of approximately 45 degrees. The upper pipe attachment member is removably inserted into a distal end of the diagonal shaft.

9 Claims, 5 Drawing Sheets

DEVICE FOR REMOVING ROTATING HEAD RUBBERS FROM DRILL PIPE

BACKGROUND OF THE INVENTION

1. Field of the Invention

The present invention relates to the field of tools for servicing oil well drilling equipment, and more particularly, for tools that remove rotating head rubbers from drill pipe.

2. Description of the Related Art

Although there are numerous devices for manipulating drill pipe that are the subject of existing patents or patent applications, none of these devices is similar to the present invention in terms of structure or function.

U.S. Pat. No. 2,690,847 (Crookston, 1954) discloses an air-powered device for positioning pipe in a drilling derrick. Compressed air is used to power air pistons and a chain drive mechanism that operate mechanical arms. The device is designed to catch and maneuver a stand of drill pipe as it is being moved from a drill rack to the center of a derrick.

U.S. Pat. No. 6,868,923 (Mitchell, 2005) discloses a portable pipe support apparatus that supports the weight of a pipe string in a borehole when pipe is being installed or removed from the drill string, wherein a pipe connection is supported at waist height to an operator. The purpose of the invention is to allow the operator to manually couple or uncouple pipes while working in an upright position, thereby avoiding the necessity for the operator to repeatedly stoop over or bend down, as occurs when the pipe connections are at ground level. The device is designed to attach to the trailer hitch of a vehicle or, alternately, rest on the ground. Unlike the present invention, the device is designed to support only downward forces (caused by the weight of the drill string) and is not designed to withstand lifting forces that occur when a rotating rubber element is stripped away from a section of drill pipe by raising the pipe. The device does not comprise clamps or other mechanisms to attach the device to a stationary pipe string for support.

U.S. Patent Application No. 2005/0061548 (Hooper et al.) discloses a powered, remotely controlled apparatus for positioning and stabbing drill pipe and well casing in a drilling rig derrick. The invention comprises a jointed articulating boom that pivots about the vertical and horizontal axes and a pipe gripper having arcuate jaws. The invention is powered by pressurized hydraulic fluid. The apparatus is typically mounted near the top of a derrick. The device is designed to assist in the lateral movement of pipe such as casing back and forth from a storage rack on the side of a derrick to the center of the drill floor and is not designed to strip rotating head rubbers from drill pipe.

U.S. Patent Application No. 2015/0075814 (Gerwing et al.) discloses a device fir positioning drill pipe equipment, such as power tongs on a rig floor. The invention provides for horizontal positioning of the equipment with no corresponding vertical movement of the equipment. The invention comprises three moveable arms that are preferably powered hydraulically or pneumatically. The invention is not designed to strip rotating head rubbers from drill pipe.

BRIEF SUMMARY OF THE INVENTION

The present invention is a device for removing rotating head rubbers from drill pipe, the device comprising: a base member; a vertical shaft; a lower pipe attachment bracket; a left arm; a right arm; a diagonal shaft; and an upper pipe attachment member; wherein the base member is removably inserted into a lower end of the vertical shaft; wherein the lower pipe attachment bracket is welded to the vertical shaft in a central portion of the vertical shaft; wherein each of the left arm and the right arm has a proximal end, and the proximal ends of the left arm and the right arm are welded to a top end of the vertical shaft; wherein the left arm and the right arm each lies in a horizontal plane, and the horizontal plane in which the left arm lies is the same as the horizontal plane in which the right arm lies; wherein the proximal ends of the left arm and the right arm are welded together and the distal ends of the left arm and the right arm separated so that the left arm and the right arm form a V-shaped fork; wherein the diagonal shaft is welded to the top end of the vertical shaft at an upward angle of approximately 45 degrees from the horizontal plane in which the left arm and the right arm lie; wherein the diagonal shaft has a distal end, and the distal end faces in an opposite direction from an open end of the V-shaped fork formed by the left arm and the right arm; and wherein the upper pipe attachment member is removably inserted into a distal end of the diagonal shaft.

In a preferred embodiment, the lower pipe attachment bracket comprises a receptacle plate and a rectangular retaining bar that is removably attached to the receptacle plate; wherein the receptacle plate comprises a hole in a proximal end of the receptacle plate, and wherein the hole in the proximal end of the receptacle plate fits around the vertical shaft; wherein a distal end of the receptacle plate forms a U-shaped opening; wherein the upper pipe attachment member comprises a semi-cylindrical segment and a diagonal stub: and wherein a center of the semi-cylindrical segment is in vertical alignment with a center of the U-shaped opening of the lower pipe attachment bracket. Preferably, the diagonal stub is welded to a center of an outside surface of the semi-cylindrical segment with an axis having a downward angle relative to a horizontal plane. An inside diameter of the semi-cylindrical segment is preferably selected to match an outside diameter of drill pipe.

In a preferred embodiment, the invention further comprises: a triangular-shaped left strut that is welded to the diagonal shaft and the left arm and a triangular-shaped right strut that is welded to the diagonal shaft and the right arm; and a handle that is welded between the left strut and the right strut with an axis in a horizontal plane that lies above the horizontal plane in which the left arm and the right arm lie. Preferably, the V-shaped fork creates an angle between the left arm and the right arm, and wherein the angle is in the range of thirty to fifty degrees.

In a preferred embodiment, the base member comprises a base plate and a vertical stub, wherein the vertical stub is welded to a center of the base plate so that an axis of the vertical stub is perpendicular to a plane of a top surface of the base plate: wherein the vertical stub and a bottom end of the vertical shaft each comprise at least one transverse hole; wherein a pin is used to secure the vertical stub to the vertical shaft; and wherein the vertical stub has a length, and the length of the vertical stub and a vertical position of the transverse holes are selected so as to provide a desired total height of the device. Preferably, a chain catch is welded to an outside surface of the semi-cylindrical segment and a chain is attached to the chain catch: and wherein the chain wraps around a drill pipe when the device is in use. A drill pipe preferably fits into the U-shaped opening of the lower pipe attachment bracket and is secured in place with the receptacle bracket when the device is in use.

REFERENCE NUMBERS

Figure 1:
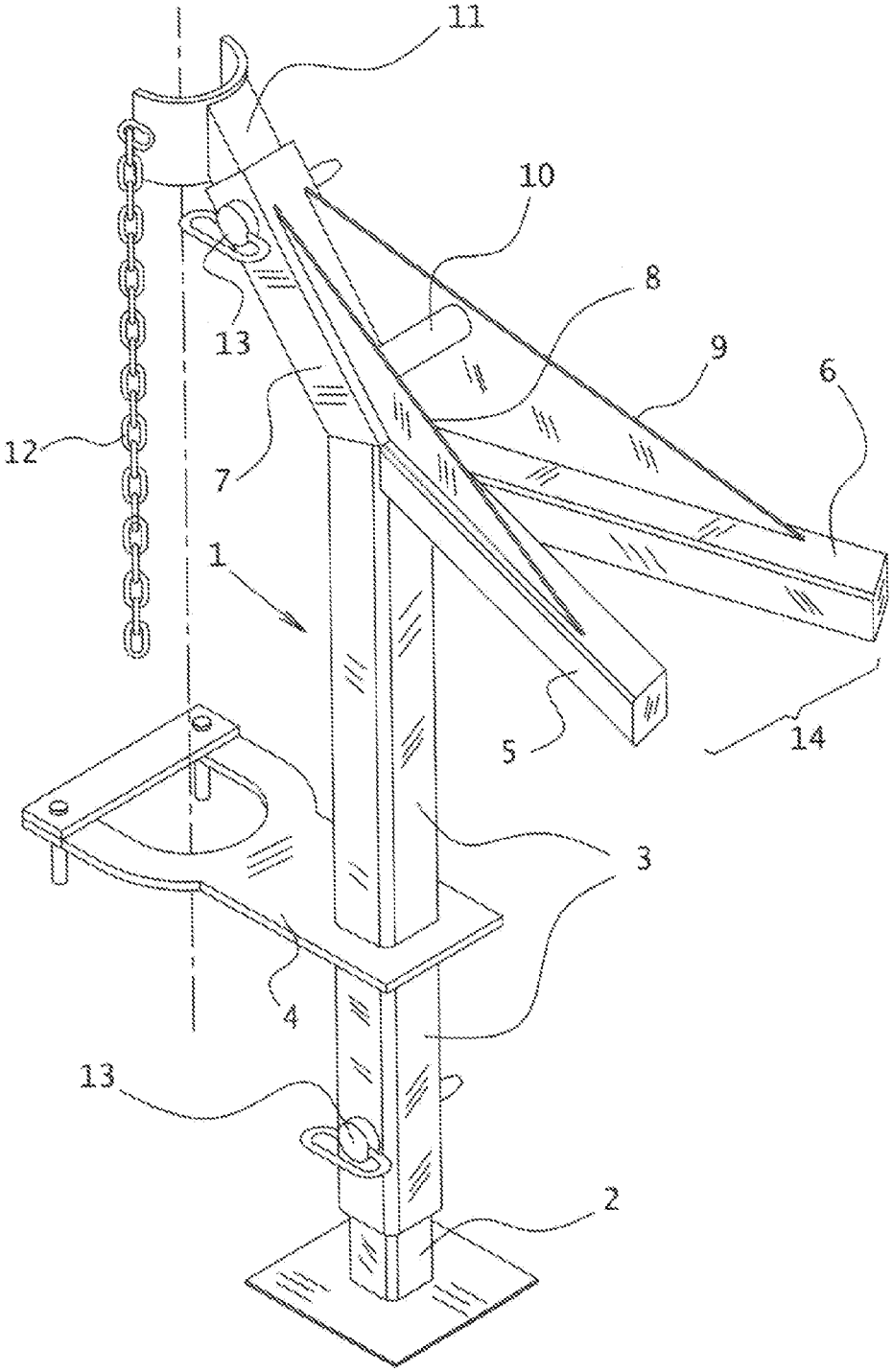
FIG. 1 is an isometric view showing the left side and top of the present invention.

1 Present invention
2 Base member
3 Vertical shaft
4 Lower pipe attachment bracket
Left arm
6 Right arm
7 Diagonal shaft
8 Left strut
9 Right strut
10 Handle
11 Upper pipe attachment member
12 Chain
13 Lock pin
14 Fork
15 Cotter pin
16 Base plate
17 Vertical stub
18 Transverse hole
19 Receptacle plate
20 Retaining bar
21 Clevis pin
22 Square hole
23 U-shaped opening
24 Semi-cylindrical segment
25 Diagonal stub
26 Chain catch
27 Slot in chain catch
28 Drill pipe
29 Rotating head rubber
30 Top stand of drill pipe
31 Stump of drill rig
32 Drill floor
33 Slips
34 Top tool joint of stump
35 Elevators
36 Bore of rotating head rubber
37 Shaft of top stand
38 Bottom tool joint of top stand

DETAILED DESCRIPTION OF INVENTION

Many oil well drilling operations incorporate a rubber seal (a/k/a "rotating head rubber") positioned around the top piece of drill pipe and held in position with a friction fit. The rotating head rubber provides a pressure-tight seal that prevents liquids and gas from escaping around the outside of the drill pipe during drilling operations. From time to time, the rotating head rubber must be removed from the drill pipe for service or replacement, and significant force is required to pull away (or "strip") the rotating head rubber from the drill pipe during these procedures. Current practice for the stripping procedure requires the attachment of tie-down chains, slings or other relatively fragile and dangerous devices to the rotating head rubber. The present invention is a tool for stripping a rotating head rubber from a piece of drill pipe that eliminates the need for attaching tie-down chains, slings or similar devices to the rotating head rubber during the stripping process. The present invention significantly reduces hazards associated with equipment failures that can occur during stripping operations that utilize current procedures.

Figure 2:
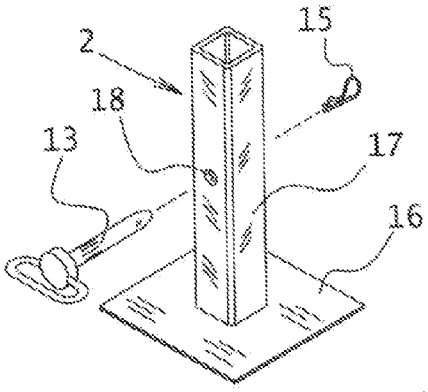
FIG. 2 is an isometric view of the base member of the present invention.
Figure 3:
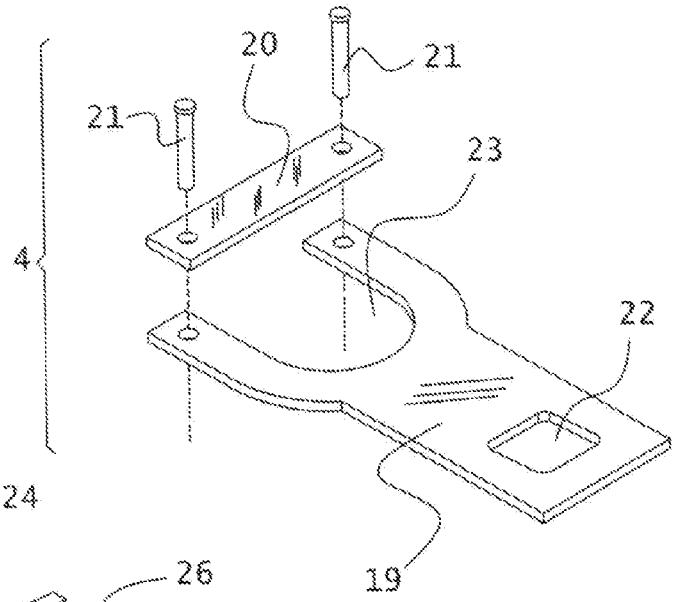
FIG. 3 is an exploded isometric view of the lower pipe attachment bracket of the present invention.
Figure 5:
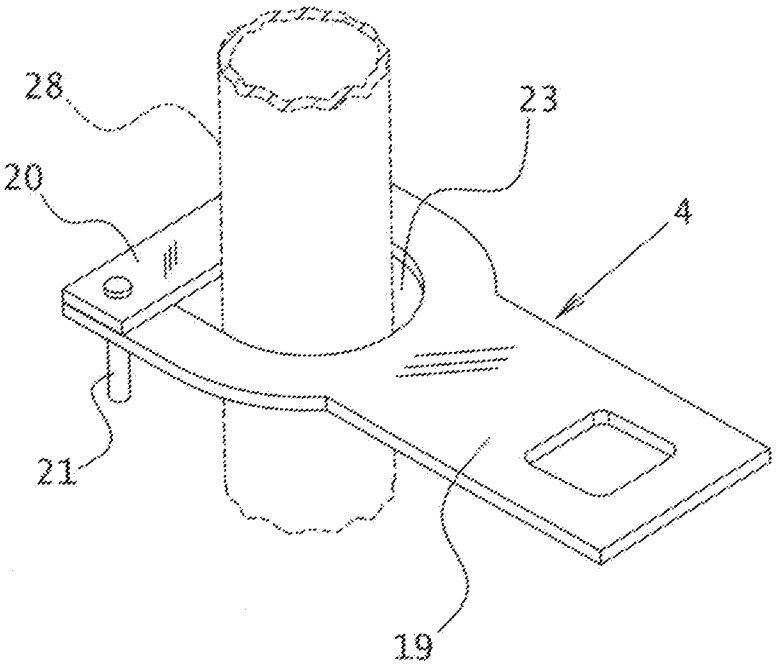
FIG. 5 is an isometric view of the lower pipe attachment bracket, shown assembled, and shown restraining a partial segment of drill pipe.

FIG. 1 is an isometric view showing the left side and top of the present invention 1. As shown, major components of the present invention 1 include a base member 2, a vertical shaft 3, lower pipe attachment bracket 4, a left arm 5, a right arm 6, a diagonal shaft 7, a left strut 8, a right strut 9, a handle 10, an upper pipe attachment member 11 and a chain 12. The base member 2, which is described in detail in reference to FIG. 2, is removably and insertably attached into the lower end of the vertical shaft 3, and locked in place with a lock pin 13 that is inserted through matching transverse holes (not shown) that are manufactured into the base member 2 and the vertical shaft 3. The vertical shaft 3 is preferably manufactured from 2½ inch square steel tubing and has a length of approximately 33 inches. The lower pipe attachment bracket 4, which is described in detail with reference to FIGS. 3 and 5, is welded to the vertical shaft 3 at a position approximately 15 inches up from the bottom of the vertical shaft 3 (in a central portion of the vertical shaft 3).

The left arm 5 and the right arm 6 are preferably manufactured from 2-inch square steel tubing. The proximal ends (i.e., the ends nearest the vertical shaft) of the left arm 5 and the right arm 6 are welded to the top end of the vertical shaft 3 in an orientation so that the axes of the left arm 5 and the right arm 6 are in the same horizontal plane, with the proximal ends welded together and the distal ends separated, so that the left arm 5 and the right arm 6 form a V-shaped fork 14 having an angle between the two arms of approximately 41 degrees (a preferable angle would be in the range of thirty to fifty degrees). The left arm 5 has a length of approximately 12 inches, and the right arm 6 has a length of approximately 13 inches, as measured from the inside V of the fork 14 to the distal end of each arm.

The diagonal shaft 7 is preferably manufactured from 2½-inch square steel tubing and is welded to the top end of the vertical shaft 3 with the axis at an upward angle of approximately 45 degrees from the horizontal plane. The diagonal shaft 7 is oriented so that the distal end (i.e., the end facing away from the vertical shaft 3) faces in the opposite direction from the open end of the fork 14. The triangular-shaped left strut 8 is welded to the diagonal shaft 7 and the left arm 5, and the similar triangular-shaped right strut 9 is welded to the diagonal shaft 7 and the right arm 6. The left strut 8 and the right strut 9 are preferably manufactured from ⅛-inch thick plate steel. The handle 10 is welded between the left strut 8 and the right strut 9, with the axis in the horizontal plane, and is preferably manufactured from 1¼-inch round steel pipe. The handle 10 is used as a carrying handle to manually position the present invention on the drill floor.

Figure 4:
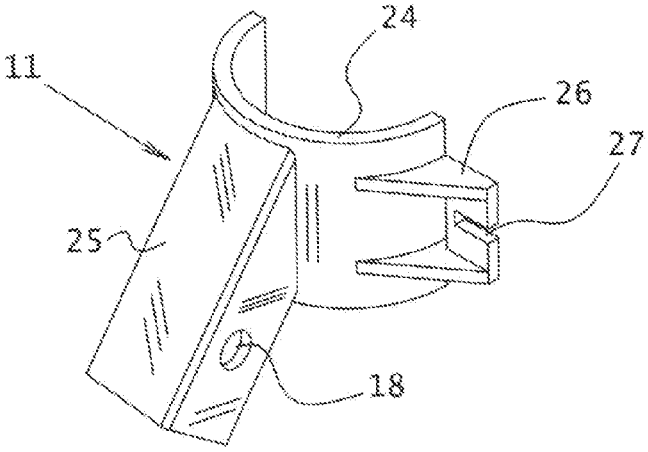
FIG. 4 is an isometric view of the right side of the upper pipe attachment member.
Figure 6:
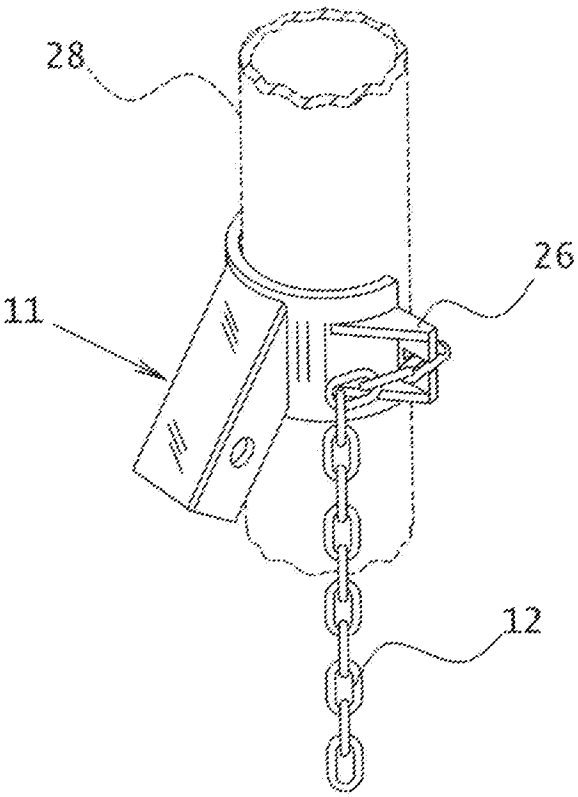
FIG. 6 is an isometric view of the right side of the upper pipe attachment member, shown restraining a partial segment of drill pipe.

The upper pipe attachment member 11, which is described in detail in reference to FIGS. 4 and 6, is removably and insertably attached into the distal end of the diagonal shaft 7 and locked in place with a lock pin 13 that is inserted through matching transverse holes (not shown) that are manufactured into the upper pipe attachment member 11 and the diagonal shaft 7. In a preferred embodiment, the chain 12 is a ⅜-inch steel chain. One end of the chain 12 is welded to the left side of the upper pipe attachment member 11. The present invention is preferably powder-coated or painted with corrosion-resistant paint. The outside dimensions of the 2-inch square steel tubing of the base plate 2 provide a relatively snug but easily slidable fit within the inside of the 2½-inch square steel tubing of the vertical shaft 3, and the outside dimensions of the 2-inch square steel tubing of the upper pipe attachment member 11 provide a relatively snug but easily slidable fit within the inside of the 2½-inch square steel tubing of the diagonal shaft 7. Hollow square steel tubing is preferred over solid steel bar stock in order to maximize the strength-to-weight ratio for fabrication of the base member 2, the vertical shaft 3, the left arm 5, the right arm 6, the diagonal shaft 7, and the upper pipe attachment member 11.

FIG. 2 is an isometric view of the base member 2 shown with a lock pin 13 that is held in position with a cotter pin 15, shown with the lock pin 13 and the cotter pin 15 separated from the base member 2 for clarity. The base member 2 comprises a base plate 16 that is preferably manufactured from ⅛-inch thick steel plate and a vertical stub 17 that is preferably manufactured from 2-inch square tubing and that incorporates a pair of transverse holes 18, one of which is shown, having a diameter of about ⅝-inch, into which the lock pin 13 is inserted. The length of the vertical stub 17 and the vertical position of the transverse holes 18 are selected so as to provide a desired total height of the present invention 1, as described in reference to FIG. 7. In a preferred embodiment, the vertical stub 17 has a length of about 10 inches, and the center of the transverse holes 18 are positioned approximately 7 inches above the base plate 16. The vertical stub 17 is preferably welded to the center of the base plate 16 with the axis perpendicular to the plane of the top surface of the base plate 16 as shown.

FIG. 3 is an exploded isometric view of the lower pipe attachment bracket 4, which comprises a receptacle plate 19 and a rectangular retaining bar 20, wherein the retaining bar 20 is removably attached to the receptacle plate 19 by two clevis pins 21 that are inserted into matching holes that are manufactured into the receptacle plate 19 and the retaining bar 20. The length of the receptacle plate 19 is approximately 16⅛ inches. The receptacle plate 19 comprises a square hole 22 that fits around the outside of the vertical shaft 3, as shown in FIG. 1. The center of the square hole 22 is positioned approximately 2¾ inches in from the proximal end (i.e., the end nearest the vertical shaft 3 as shown in FIG. 1) of the receptacle plate 19. The distal end of the receptacle plate 19 forms a U-shaped opening 23 having a width of about 5¾ inches and a depth of about 6½ inches. In a preferred embodiment, the receptacle plate 19 and the retaining bar 20 are manufactured from ⅜-inch thick steel plate, and the clevis pins 21 are manufactured from chrome-plated steel.

FIG. 4 is an isometric view of the right side of the upper pipe attachment member 11, shown with the chain removed for clarity. The upper pipe attachment member 11 comprises semi-cylindrical segment 24 that is preferably manufactured from a half-section of steel pipe with the axis of the pipe oriented in a vertical plane, and a diagonal stub 25 that is preferably manufactured from 2-inch square steel tubing. The inside diameter of the semi-cylindrical segment 24 is preferably selected to match the outside diameter of the drill pipe used for a particular application, and the upper pipe attachment member 11 is therefore preferably manufactured in a variety of sizes, making the present invention compatible with a variety of drill pipe sizes. The diagonal stub 25 is welded to the center of the outside surface of the semi-cylindrical segment 24 with the axis having a downward angle of approximately 135 degrees from the horizontal plane. The diagonal stub 25 comprises a pair of transverse holes 18 (one of which is shown) that accept a lock pin 13 as shown in FIG. 1. A chain catch 26 is welded to the outside surface of the right side of the semi-cylindrical segment 24. The chain catch 26 comprises a slot 27 that is sized so as to accept a link of the chain 12, as shown in FIG. 6. When the present invention 1 is assembled, the center of the semi-cylindrical segment 24 is in vertical alignment with the center of the circular portion of the U-shaped opening 23 of the lower pipe attachment bracket 4, as illustrated by the dashed line shown on FIG. 1.

FIG. 5 is an isometric view of the lower pipe attachment bracket 4, shown assembled, and shown restraining a partial segment of drill pipe 28, with the drill pipe 28 shown in phantom. As illustrated, the U-shaped opening 23 is not required to provide a snug fit around the drill pipe 28 in order for the present invention to operate properly; therefore, the lower pipe attachment bracket may be used without modification for a wide range of drill pipe sizes, for example 3½ inch to 5-inch (nominal drill pipe size).

FIG. 6 is an isometric view of the right side of the upper pipe attachment member 11, shown restraining a partial segment of drill pipe 28, with the drill pipe 28 shown in phantom. The drill pipe 28 is held in place by the chain 12, which wraps around the drill pipe 28 and is secured into the chain catch 26.

Figure 7:
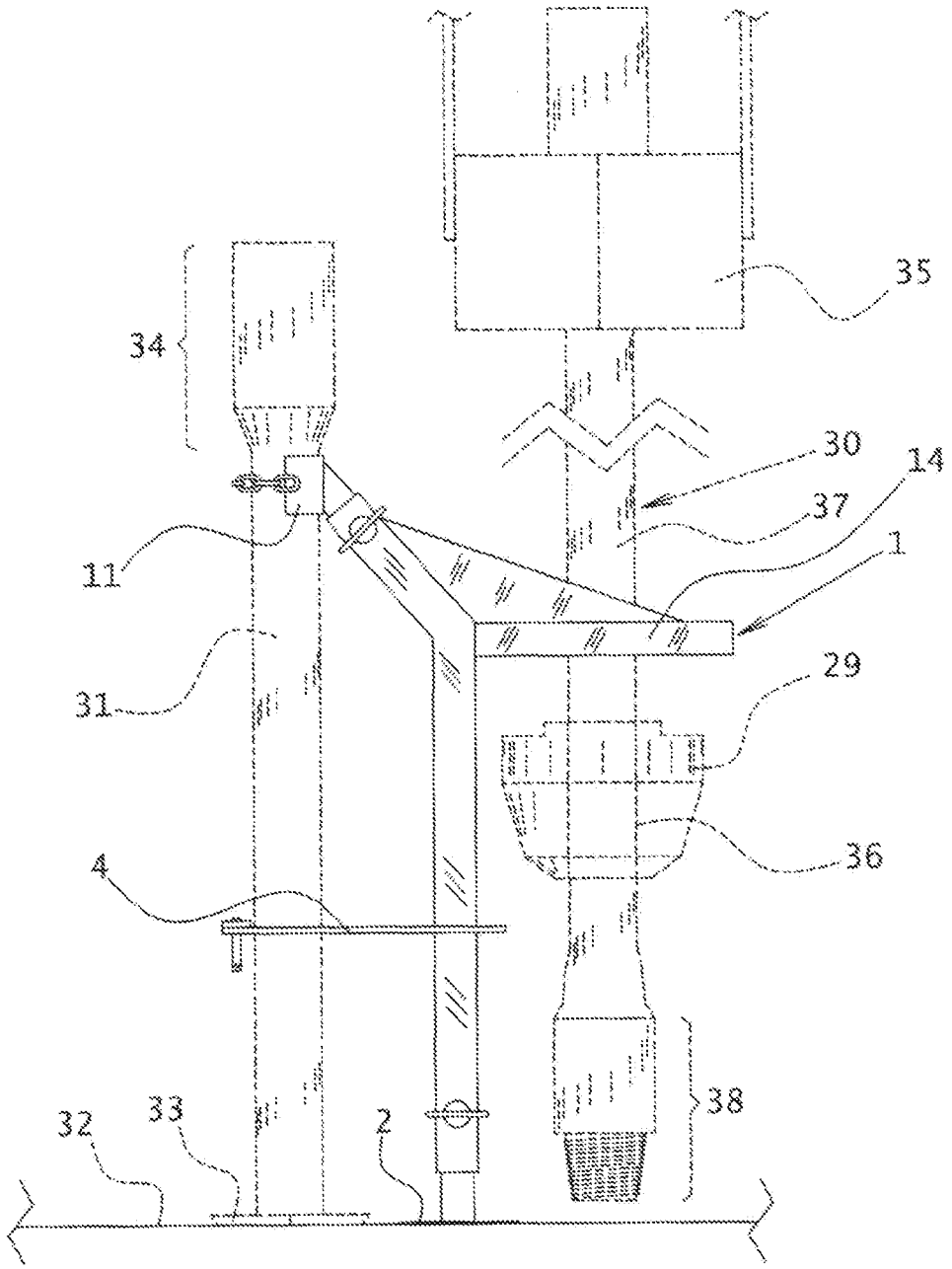
FIG. 7 is a left side view of the present invention installed on a drill floor and ready to be utilized to strip a rotating head rubber from a top stand of drill pipe.

FIG. 7 is a left side view of the present invention 1 installed on a drill floor and ready to be utilized to strip a rotating head rubber 29 from a top stand 30 of drill pipe. As shown, a stump 31 of drill string is hanging down into a borehole and is being supported on a drill floor 32 by a set of slips 33. The present invention 1 is positioned with the base member 2 sitting flush on the drill floor 32, the lower pipe attachment bracket 4 attached to the stump 31 (as shown in detail in reference to FIG. 5), and the upper pipe attachment member 11 also attached to the stump 31 (as shown in detail in reference to FIG. 6). The height of the present invention 1 is adjusted by selecting a base member 2 having dimensions so that the upper pipe attachment member 1I is connected around the stump 31 just below the top tool joint 34.

The top stand 30 is supported by a set of elevators 35, which can raise and lower the top stand 30 as required. The top stand 30 is positioned within the fork 14, with the rotating head rubber 29 positioned below the fork 14. The rotating head rubber 29 is a commercial product comprised of a flexible and elastic material such as synthetic rubber. The rotating head rubber 29 comprises a cylindrical bore 36 that is sized to maintain a snug friction fit around the shaft 37 of the top stand. The flexibility of the rotating head rubber 29 allows the diameter of the bore 36 to expand so that the rotating head rubber 29 can be stripped over the bottom tool joint 38 of the top stand 30 when sufficient downward force is applied to the rotating head rubber 29.

Figures 8, 9:
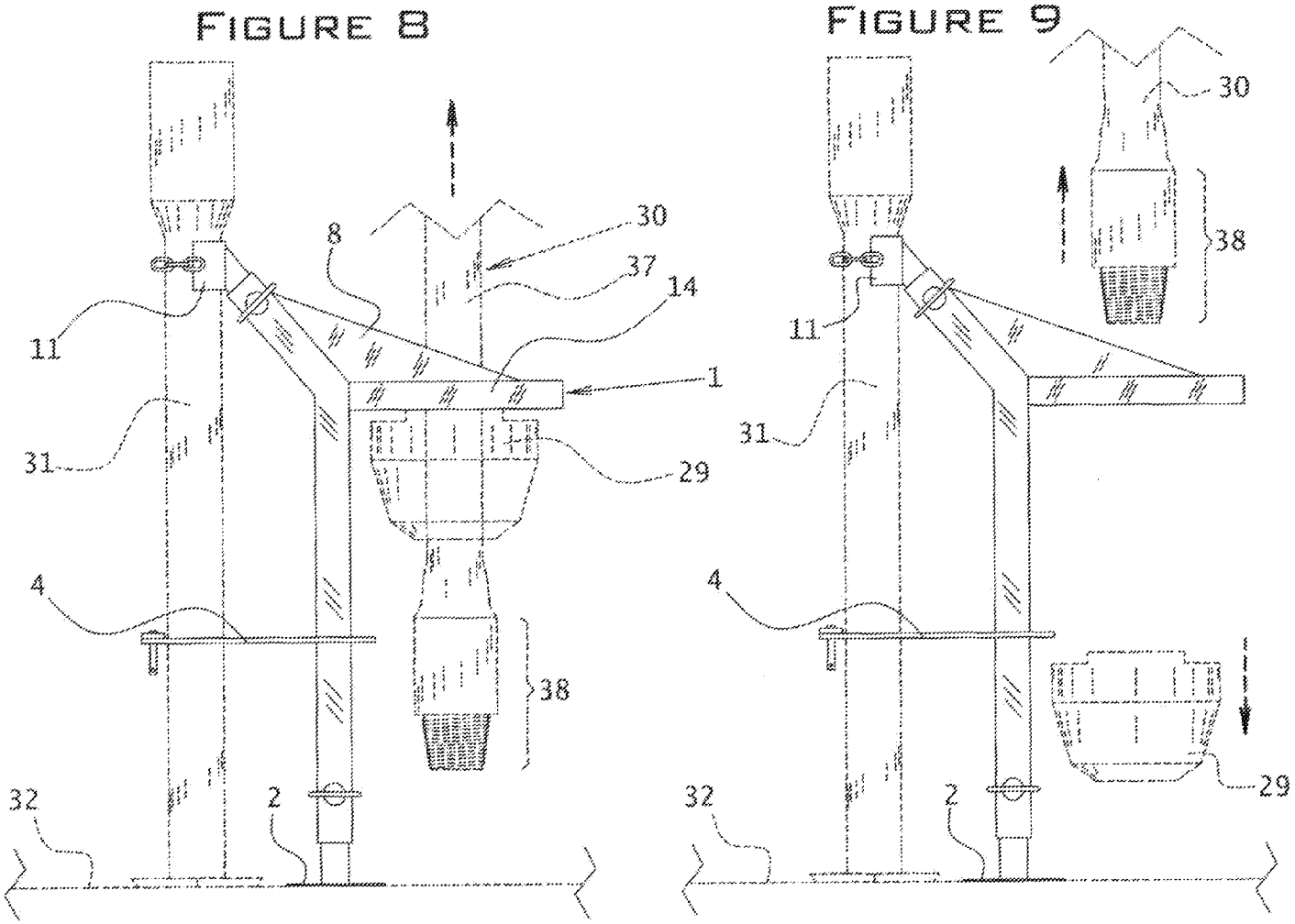
FIG. 8 is a left side view of the present invention being used to strip a rotating head rubber from a stand of drill pipe, shown as the drill pipe is being pulled through the fork of the present invention.
FIG. 9 is a left side view of the present invention being used to strip a rotating head rubber from a stand of drill pipe, shown after the drill pipe has been pulled through the fork of the present invention.

FIGS. 8 and 9 are left side views that illustrate the present invention 1 being used to strip a rotating head rubber 29 from a stand of drill pipe. FIG. 8 shows the top stand 30 being pulled upward through the fork 14 as illustrated by the upward-facing dashed arrow, while the rotating head rubber 29 is prevented from moving upward by the fork 14, thereby causing the rotating head rubber 29 to be pushed downward, or stripped, along the shaft 37 of the top stand 30. The lower pipe attachment bracket 4 and the upper pipe attachment member 11 secure the present invention 1 to the stump 31, thereby preventing the present invention 1 from being pulled upward along with the upwardly moving top stand 30. The left strut 8 and the right strut 9 (not shown) provide extra strength to resist buckling of the present invention 1 due to forces imparted by the rotating head rubber 29 pushing upward against the bottom of the fork 14 as the top stand 30 moves upward.

FIG. 9 shows the top stand 30 having been pulled upward sufficiently so that the rotating head rubber 29 has been stripped over the bottom tool joint 38 of the top stand 30 and is falling to the drill floor 32. The upward motion of the top stand 30 is illustrated by the upward-facing dashed arrow, and the downward motion of the rotating head rubber 29 as it falls to the drill floor 32 is illustrated by the downward-facing dashed arrow.

The present invention is designed to be portable so that it can be quickly and easily attached to a stump of drill string for a stripping procedure and then quickly and easily detached from the stump when no longer needed on the drill floor.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A device for removing rotating head rubbers from drill pipe, the device comprising:

(a) a base member;

(b) a vertical shaft;

(c) a lower pipe attachment bracket;

(d) a left arm;

(e) a right arm;

(f) a diagonal shaft; and (j) an upper pipe attachment member;

wherein the base member is removably inserted into a lower end of the vertical shaft;

wherein the lower pipe attachment bracket is welded to the vertical shaft in a central portion of the vertical shaft;

wherein each of the left arm and the right arm has a proximal end, and the proximal ends of the left arm and the right arm are welded to a top end of the vertical shaft;

wherein the left arm and the right arm each lies in a horizontal plane, and the horizontal plane in which the left arm lies is the same as the horizontal plane in which the right arm lies;

wherein the proximal ends of the left arm and the right arm are welded together and the distal ends of the left arm and the right arm separated so that the left arm and the right arm form a V-shaped fork;

wherein the diagonal shaft is welded to the top end of the vertical shaft at an upward angle of approximately 45 degrees from the horizontal plane in which the left arm and the right arm lie;

wherein the diagonal shaft has a distal end, and the distal end faces in an opposite direction from an open end of the V-shaped fork formed by the left arm and the right arm; and wherein the upper pipe attachment member is removably inserted into a distal end of the diagonal shaft.

2. The device of claim 1, wherein the lower pipe attachment bracket comprises a receptacle plate and a rectangular retaining bar that is removably attached to the receptacle plate;

wherein the receptacle plate comprises a hole in a proximal end of the receptacle plate, and wherein the hole in the proximal end of the receptacle plate fits around the vertical shaft;

wherein a distal end of the receptacle plate forms a U-shaped opening;

wherein the upper pipe attachment member comprises a semi-cylindrical segment and a diagonal stub; and wherein a center of the semi-cylindrical segment is in vertical alignment with a center of the U-shaped opening of the lower pipe attachment bracket.

3. The device of claim 2, wherein the diagonal stub is welded to a center of an outside surface of the semi-cylindrical segment with an axis having a downward angle relative to a horizontal plane.

4. The device of claim 2, wherein an inside diameter of the semi-cylindrical segment is selected to match an outside diameter of drill pipe.

5. The device of claim 2, wherein a chain catch is welded to an outside surface of the semi-cylindrical segment and a chain is attached to the chain catch; and wherein the chain wraps around a drill pipe when the device is in use.

6. The device of claim 2, wherein a drill pipe fits into the U-shaped opening of the lower pipe attachment bracket and is secured in place with the receptacle bracket when the device is in use.

7. The device of claim 1, further comprising:

a triangular-shaped left strut that is welded to the diagonal shaft and the left arm and a triangular-shaped right strut that is welded to the diagonal shaft and the right arm; and a handle that is welded between the left strut and the right strut with an axis in a horizontal plane that lies above the horizontal plane in which the left arm and the right arm lie.

8. The device of claim 1, wherein the V-shaped fork creates an angle between the left arm and the right arm, and wherein the angle is in the range of thirty to fifty degrees.

9. The device of claim 1, wherein the base member comprises a base plate and a vertical stub, wherein the vertical stub is welded to a center of the base plate so that an axis of the vertical stub is perpendicular to a plane of a top surface of the base plate;

wherein the vertical stub and a bottom end of the vertical shaft each comprise at least one transverse hole;

wherein a pin is used to secure the vertical stub to the vertical shaft; and wherein the vertical stub has a length, and the length of the vertical stub and a vertical position of the transverse holes are selected so as to provide a desired total height of the device.

* * * * *